US008348203B2

(12) United States Patent
Ortiz Rivas

(10) Patent No.: US 8,348,203 B2
(45) Date of Patent: Jan. 8, 2013

(54) LEVELING RAIL JOINTS FOR RAILS OF DIFFERENT HEIGHT CHARACTERISTICS WITH PLANE SUPPORT

(76) Inventor: Arturo A. Ortiz Rivas, Monterrey (MX)

( * ) Notice: Subject to any disclaimer, the term of this patent is extended or adjusted under 35 U.S.C. 154(b) by 0 days.

(21) Appl. No.: 12/852,065

(22) Filed: Aug. 6, 2010

(65) Prior Publication Data

US 2012/0031990 A1 Feb. 9, 2012

(51) Int. Cl.
*E01B 7/00* (2006.01)

(52) U.S. Cl. ..... 246/454; 238/159; 238/172

(58) Field of Classification Search ..... 238/159, 238/243, 244, 248, 250, 251, 253, 260, 151, 238/186, 203, 234, 242
See application file for complete search history.

(56) References Cited

U.S. PATENT DOCUMENTS

| | | | | | |
|---|---|---|---|---|---|
| 862,645 | A * | 8/1907 | Lewis | 246/462 |
| 1,072,866 | A * | 9/1913 | McEvoy et al. | 246/460 |
| 1,089,058 | A * | 3/1914 | Keller | 238/186 |
| 1,201,815 | A * | 10/1916 | Forbes | 238/244 |
| 1,335,385 | A * | 3/1920 | Mitchell | 246/460 |
| 1,369,697 | A * | 2/1921 | Mulzer | 238/234 |
| 1,395,136 | A * | 10/1921 | Pleshe | 238/172 |
| 1,639,620 | A * | 8/1927 | Troup | 238/203 |
| 1,871,977 | A * | 8/1932 | Frickey | 238/164 |
| 2,161,340 | A * | 6/1939 | Disbrow | 238/159 |
| 2,531,656 | A * | 11/1950 | Thonger | 238/167 |
| 2,793,816 | A * | 5/1957 | Lansing | 238/243 |
| 3,199,855 | A * | 8/1965 | Miller | 238/83 |
| 4,386,736 | A * | 6/1983 | Benkler et al. | 238/159 |
| 4,466,570 | A * | 8/1984 | Howard | 238/153 |
| 4,630,772 | A * | 12/1986 | Watanabe et al. | 238/159 |
| 5,456,430 | A * | 10/1995 | Ortiz-Rivas | 246/468 |
| 5,503,331 | A * | 4/1996 | Uramson et al. | 238/152 |
| 5,765,785 | A * | 6/1998 | Ortiz Rivas | 246/465 |
| 6,119,988 | A * | 9/2000 | Rivas | 246/454 |
| 6,254,038 | B1 * | 7/2001 | Ortiz Rivas | 246/454 |
| 6,276,643 | B1 * | 8/2001 | Ortiz Rivas | 246/454 |
| 2009/0302125 | A1 * | 12/2009 | Urmson, et al. | 238/159 |
| 2010/0090018 | A1 * | 4/2010 | Akhtar et al. | 238/159 |

OTHER PUBLICATIONS

American Railway Engineering and Maintenance of Way Association, Identification of: Compromise Joints, Compromise Rails—Plan 700B-10, Jan. 1934.
American Railway Engineering and Maintenance of Way Association, Identification of: Compromise Joints, Compromise Rails—Plan 700B-42, Jan. 1942.

* cited by examiner

*Primary Examiner* — Jason C Smith
(74) *Attorney, Agent, or Firm* — Bracewell & Giuliani LLP

(57) ABSTRACT

A leveling joint between connected ends of two rails of different height is provided with a connector/juncture bar member which is configured to fit with and engage corresponding surfaces formed on the rails when the rails are connected together. The leveling joint so formed is one with increased strength, with ease and accuracy of alignment during assembly. The leveling joint is formed of several structural members, yet functions as and affords the strength and stability of a solid, unitary assembly.

6 Claims, 4 Drawing Sheets

LEVELING RAIL JOINTS FOR RAILS OF DIFFERENT HEIGHT CHARACTERISTICS WITH PLANE SUPPORT

CROSS REFERENCE TO RELATED APPLICATION

The present application is related to my co-pending U.S. patent applications entitled "Composite Rail Joints For Different Rail Profiles", filed of even date herewith, Ser. No. 12/852,024, and "Leveling Rail Joints With Oblique Support", filed of even date herewith, Ser. No. 12/852,006.

BACKGROUND OF THE INVENTION

1. Field of the Invention

The present invention relates to rail joints for the connection of two rails of different height.

2. Description of the Related Art

A railroad way is formed by joining two sets of parallel rails together, each set of rails formed of a number of rails connected lengthwise at their adjoining aligned ends. When one of the installed rails required replacement due to breakage, damage or completion of useful service life, the old installed rail has been replaced with a replacement or substitute rail, which could be a new or a used rail. In such cases, the replacement or substitute rail has often been a different height than that of the connecting rail to which connection was made. Compromise rail joints have been provided for use in an attempt to maintain adjoining ends of rails in place when the rails have differing height. Compromise rail joints have been provided in an attempt to compensate for transitions between adjoining rail ends of different height, but problems have remained.

So far as is known, the webs and heads of existing track at the rail ends were formed with curved surfaces, and the joints had generally flat surfaces except at surfaces formed on upper and lower edge portions. However, problems have been found to occur. Due to the rolling process of forming rails, there were minor variations in the various angles and ratios at the rail ends as well as elsewhere along their length. The dimensions and slope of the central flat portion of the web, and the curved surfaces below the head portion and the base, as well as their relative spacing, usually had minor variations between different rails, even if of the same nominal size. Similarly, the existing joints typically also had variation in dimensions and shape, even if of the same nominal size and height.

It was thus difficult to achieve a proper match and engagement between the rail ends and joints when replacement rails were being installed. In situations where a properly fitted match between the contact surfaces of the rails and the joint was not achieved, the assembled structure often exhibited less relative strength, and the assembled structure had a reduced service life.

SUMMARY OF THE INVENTION

Briefly, the present invention provides new and improved rail track structure formed at adjoining end portions of rails which have differing height. The rail track structure includes a first track and a second segment having a web portion, a base portion and a head portion, the web portions of the first and second track segments having a number of connector holes formed therein for the passage of connectors at their end portions. The head portions of the first and second track segments have horizontal flat surfaces formed on their lower portions. The base portions of the first and second track segment has horizontal flat surfaces formed on their upper portions.

The rail track structure also includes a new and improved leveling joint according to the present invention. The leveling joint according to the present invention is in the form of an elongate joint body to span the adjoining end portions of the rails to be joined. The joint body has a number of connector holes formed in it which are aligned with connector holes in web portions of the adjoining end portions of the rails to be joined. The joint body also includes an engaging shoulder member extending inwardly along its length towards the web of the rails. The engaging member also has a number of connector holes formed through it which are aligned with the connector holes in the joint body and the connector holes in web portions of the adjoining end portions of the rails. The engaging shoulder member has an inwardly extending beam portion with a vertical contact surface for engaging corresponding flat vertical surfaces on the web portions of the adjoining end portions of the rails. The joint body is located outwardly of the engaging shoulder member and is adapted to be fitted between head and base portions of the adjoining end portions of the rails being joined. The joint body has a downwardly extending contact rib member formed along its length. The contact rib member having a horizontal contact surface formed on it for engaging with a corresponding horizontal flat surface formed on a sloped surface of base portions the adjoining end portions of the rails to be joined.

The present invention provides new and improved leveling rail joints where the fitting, engagement and engagement with the rails being connected at their end portions is made by a set of joint or connector bodies that provide increased strength to the assembly. The contact areas of the connector bodies of the joint have cornered and flat surfaces both vertical and horizontal that abut with and engage corresponding surfaces the profile of rails machined according to U.S. Pat. Nos. 6,119,988; 6,254,038; and 6,276,643, of which Applicant is inventor. The subject matter of these patents is herein expressly incorporated by reference.

BRIEF DESCRIPTION OF THE DRAWINGS

The characteristic details of the present invention are clearly shown in the following description and accompany figures, which illustrate this and provide points of reference to indicate the same parts in the figures shown.

DETAILED DESCRIPTION OF THE PREFERRED EMBODIMENTS

Figure 1:
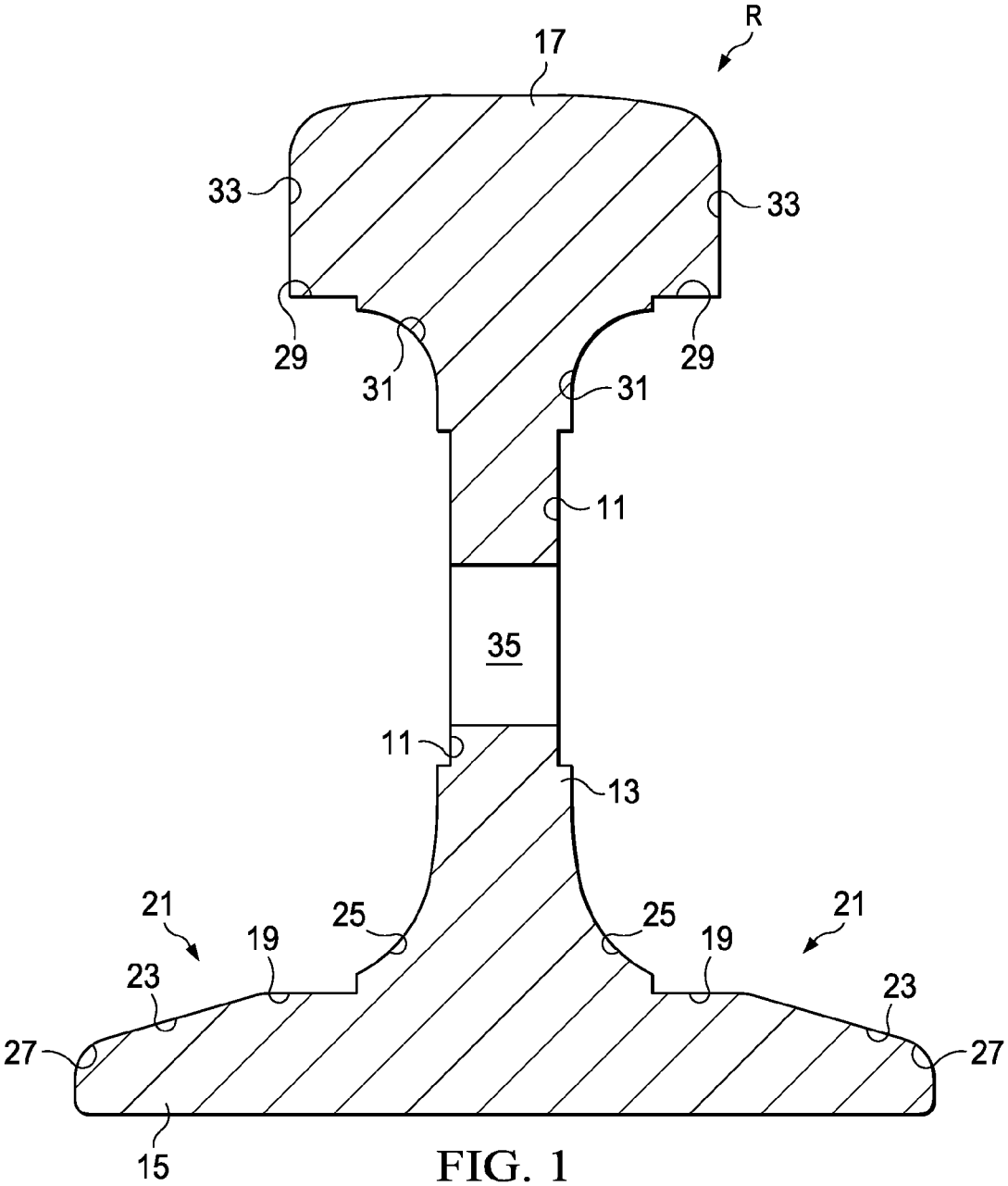
FIG. 1 is a cross-sectional view or rail profile of an end portion of an example rail joint to be joined to an adjacent end portion of another rail of different height according to the present invention.
Figure 2:
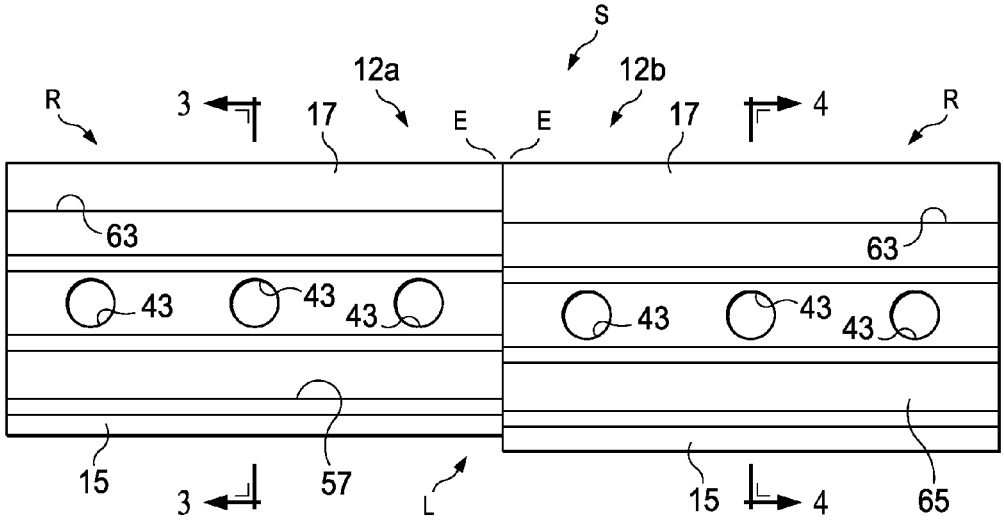
FIG. 2 is a side view of a leveling rail joint according to the present invention for joining rails of different height characteristics.
Figure 5:
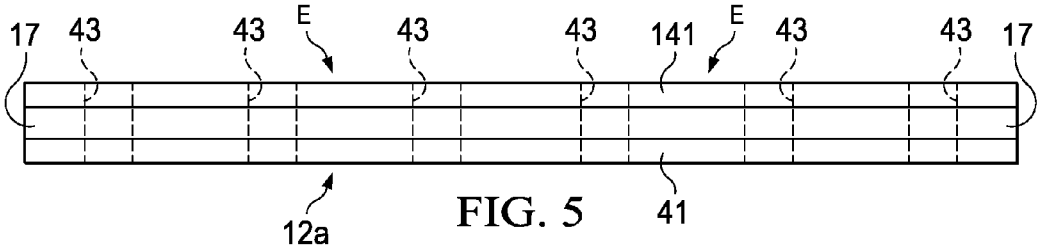
FIG. 5 is a plan view of the leveling rail joint of FIG. 2.

In the drawings, the letter S designates generally a railroad track structure formed by a leveling rail joint L between a pair of adjacent track components, such as rail sections or segments R whose end portions E are to be joined. As will be set forth below, the adjoining end portions E of rails R which are joined by the leveling rail joint L have differing height characteristics. The other aspects of the profiles of the rails R are substantially alike. The rails R are at their end portions E of the type disclosed in Applicant's U.S. Pat. Nos. 6,119,988; 6,254,038 and 6,276,243, each of which is incorporated herein by reference.

Turning first to the rails R, the adjoining end portions E of the rails R to be joined have a different height. The differences may be the result of one of the rails R having become shorter in height as a result of a period of service usage, or of different design height, or for other reasons.

Each of the rails R has a flat vertical surface 11 formed on each side of a web portion 13 between a foot or base portion 15 and a head portion 17. The flat vertical surfaces 11 on the rail web 13 are formed in the manner disclosed in Applicant's previously mentioned U.S. Pat. No. 6,119,988; U.S. Pat. No. 6,254,038 and U.S. Pat. No. 6,276,243, and Applicant's U.S. Pat. No. 5,765,785, which is also incorporated herein by reference. The vertical flat surfaces 11 serve as precise measurement and alignment references for other surfaces formed on the rails R and other components of the structure S, as will be set forth below.

Each of the rails R also includes a horizontal flat surface 19 formed on an intermediate area 21 of each outwardly sloped upper surface 23 of the base portion 15. The flat surfaces 19 are formed in the intermediate areas 21 between a lower radius area 25 of the web portion 13 and an outer edge 27 of a lower side portion of the base portion 15. The horizontal flat surface 19 on the rail base portion 15 is formed at a location between the outer edge 27 of the base portion and the web 13 of the rail end portion E. The flat surfaces 19 are formed in a common horizontal plane which is perpendicular within the accuracy of precision machining tolerances to the vertical plane in which the flat vertical surface 11 of the web portion 13 is formed.

Each of the rails R also includes a horizontal flat surface 29 formed on each lower inwardly curving surface or radius 31 beneath the head portion 17. The flat surfaces 29 are formed extending inwardly from a side edge portion 33 at its juncture with the inwardly curving surface 31 below the head portion 17. The flat surfaces 29 of the head portion 17 are formed in a common horizontal plane as shown.

The horizontal plane of each flat surface 29 is perpendicular within the accuracy of machining tolerances to the vertical plane in which the flat surface 11 of the web portion 13 is formed. The horizontal plane of flat surfaces 29 is thus parallel within the accuracy of machining tolerances to the horizontal plane of the flat surface 19 in the base portion 15. The web portions 13 of the rails R have a suitable number of connector ports or holes 35 spaced along the longitudinal extent of the end portions E for passage of connector bolts or other suitable fastener mechanisms.

The leveling rail joint L according to the present invention is in the form of an elongate joint body 41 to span the adjoining end portions E of the rails R to be joined. The length of the joint body 41 and its extent along the adjoining end portions E with which it is mounted are determined by the intended service or usage nature of the rails R and load bearing considerations.

The joint body 41 is formed of suitable strength alloy steel, depending upon the intended load and service usages of the rail structure S. Alloy steel bars are machined with cornered and flat surfaces, as will be described to form the joint body 41. The joint body 41 has a suitable number of connector holes or ports 43 formed through it along its longitudinal extent. The connector holes 43 are spaced from each other along the joint body 41 at locations aligned with the connector holes 35 in web portions 13 of the adjoining end portions E of the rails R to be joined.

The joint body 41 also includes an engaging shoulder member 47 extending inwardly along the length of body 41 towards the web section 13 of the rail end portions E. The engaging shoulder member 47 also has a number of connector holes 49 along its longitudinal extent. The connector holes 49 are aligned with the connector holes 43 in the joint body 41 and the connector holes 35 in web portions 13 of the adjoining end portions E of the rails R. The connector holes or passages 35, 43 and 49 allow bolts and other suitable connecting mechanisms to be inserted to connect these components of the composite rail joint L with each other.

The engaging shoulder member 47 has an inwardly extending bar or body portion 51 with a vertical contact surface 53 for engaging corresponding flat vertical surfaces 11 on the web portions 13 of the adjoining rail end portions E. The joint body 41 is located outwardly of the engaging shoulder member 47 and is adapted to be fitted between head portion 17 and base portion 15 of the adjoining rail end portions E. The joint body 41 has a downwardly extending contact rib member 55 formed along its length. The contact rib member 55 has a horizontal contact surface 57 formed on it for engaging with a corresponding horizontal flat surface 19 formed on the sloped upper surface 23 of base portions 15 of the adjoining rail end portions E to be joined by the leveling rail joint L.

The horizontal contact surface 57 formed on contact rib member 55 is perpendicular to the vertical contact surface 53 on the shoulder member 47 within the limits of machine tolerance accuracies. The spacing of the horizontal surface 57 from the vertical surface 53 on the joint body 41 conforms to the spacing of the surfaces 19 and 11, respectively, on the rail end portions E. In this way, when the vertical surfaces 53 and 11 are in proper engagement, the horizontal surfaces 57 and 19 are also firmly in contact and aligned in proper engagement.

The joint body 41 also has an upwardly extending contact rib member 61 formed on an upper surface of the joint body 41 along the extent of length spanning the end sections E. The upper contact rib member 61 has a horizontal upper contact surface 63 formed thereon for engaging a corresponding horizontal flat surface 29 below the head portions 17 of the rail ends E to be joined. The horizontal flat upper contact surface 29 below the head portions 17 of the rails R are formed extending inwardly from a side surface 33 of the head portions 17 of the rail ends E to be joined.

The horizontal upper contact surface 63 is adapted for mounting on and in engagement with horizontal flat surfaces 29 on head portions 17 of adjacent rail end portions E. The horizontal contact surface 63 is perpendicular to the vertical contact surface 53 of the shoulder member 47 within the limits of machining tolerance accuracy. The spacing of the vertical surface 53 of the shoulder members 47 from the horizontal contact surface 63 conforms to the spacing of the surfaces 17 and 11 formed on the adjacent rail end portions E. The spacing of the horizontal surfaces 57 and 63 from each other on the shoulder member 47 matches that of the distance of the flat surfaces 19 and 23 in the rail end portions E.

When the vertical surfaces 53 on the shoulder member 47 are brought into contact with the vertical flat surfaces 11 on each side of the adjacent rails R, and are in proper engagement, the horizontal flat surfaces 57 and 63 of the joint bodies 41 are fittingly engaged with the horizontal contact surfaces 19 and 27, respectively, of the rail end portions E. The components of the leveling rail joint L and the assembled rail structure S are thus in proper, load bearing and load transfer fitting engagement. The joint body 41 has a horizontally thicker support segment 65 in its central portion around the connector ports 43 and extending outwardly beyond the head portions 17 of the rails R to provide additional strength to the assembled leveling joint L, particularly in the area where connector bolts are inserted and tightened.

The joint body 41 shown in the drawings is configured to be installed on the outer side of rails R at end portions E to form a composite joint where a first rail 12*a* is shorter or of lesser height than a second rail 12*b*. The joint between rails 12*a* and 12*b* could be on either of the parallel rails of a section of track. The difference in height may be from differences in height of head portions or web portions, or both, between the two rails. Thus in the joint body 41 the heights and relative spacing of the engaging shoulder member 47, body portion 51, rib members 55 and 61 and the contact surfaces formed thereon are different on either side of a midpoint (as indicated by a vertical line 71) to conform to the transitions in dimensions between the height of the outer side of the rail end portions E. It is usually the practice to position a load bearing plate member or shim beneath the foot or base portion 15 of the shorter rail for load transfer purposes.

In an installed leveling joint L, a second joint body 141 is provided to be installed opposite the joint body 41 on inner side of the rails 12*a* and 12*b* of different height. The joint body 141 has like structural components to the joint body 41, but the relative spacing of the engaging shoulder member 47, body portion 51, rib members 55 and 61 and the contact surfaces formed on joint body 141 are reversed from those of joint body 41. Accordingly, the dimensions and relative spacing of structural features of joint body 141 conform to the transitions in dimensions between the height of the inner side of the rail end portions E. In vertical cross-section (FIGS. 3 and 4) the joint bodies 41 and 141 are in effect mirror images of each other.

Figure 3:
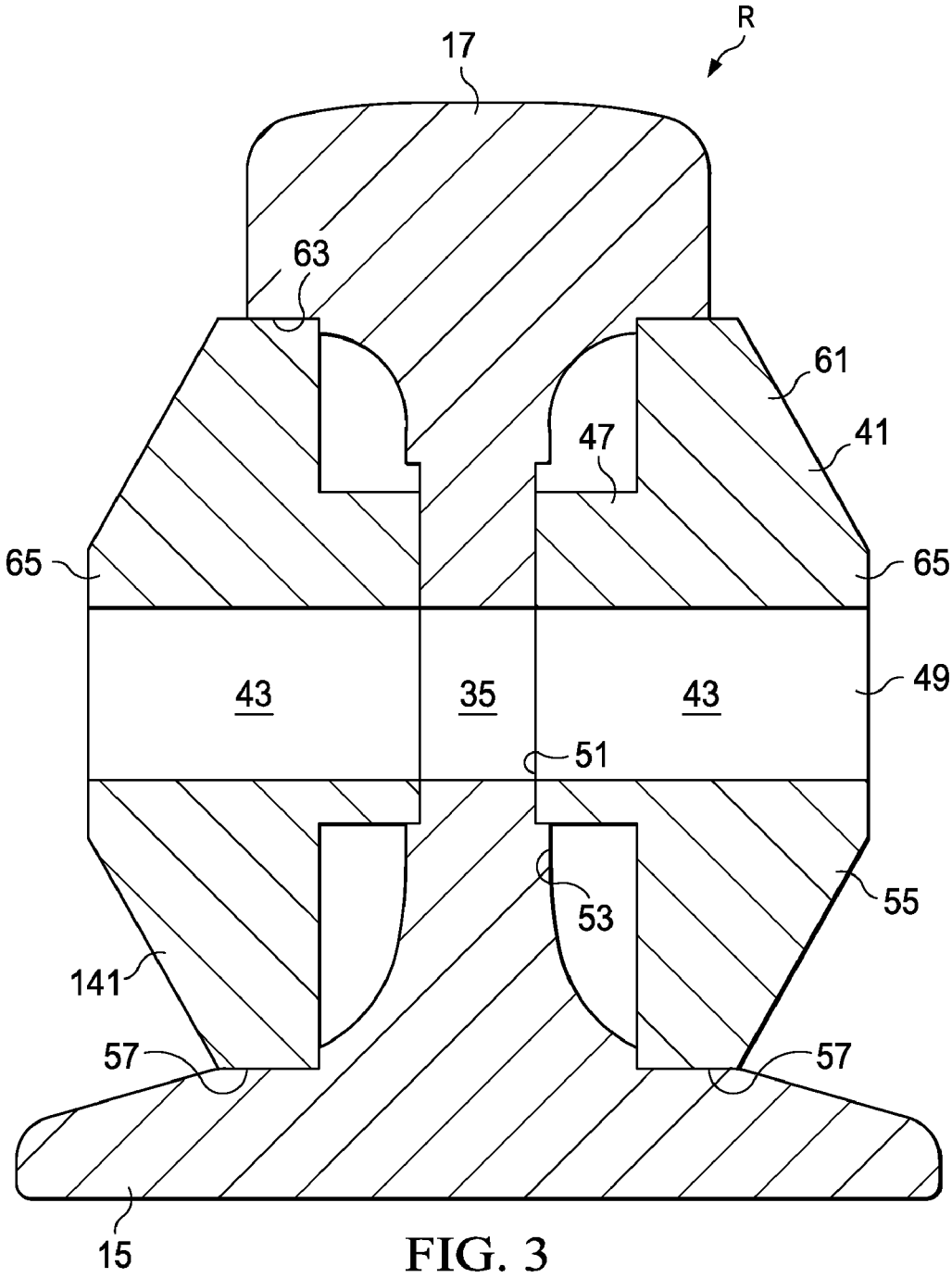
FIG. 3 is a cross-sectional view taken along the lines 3-3 of the leveling rail joint of FIG. 2.
Figure 4:
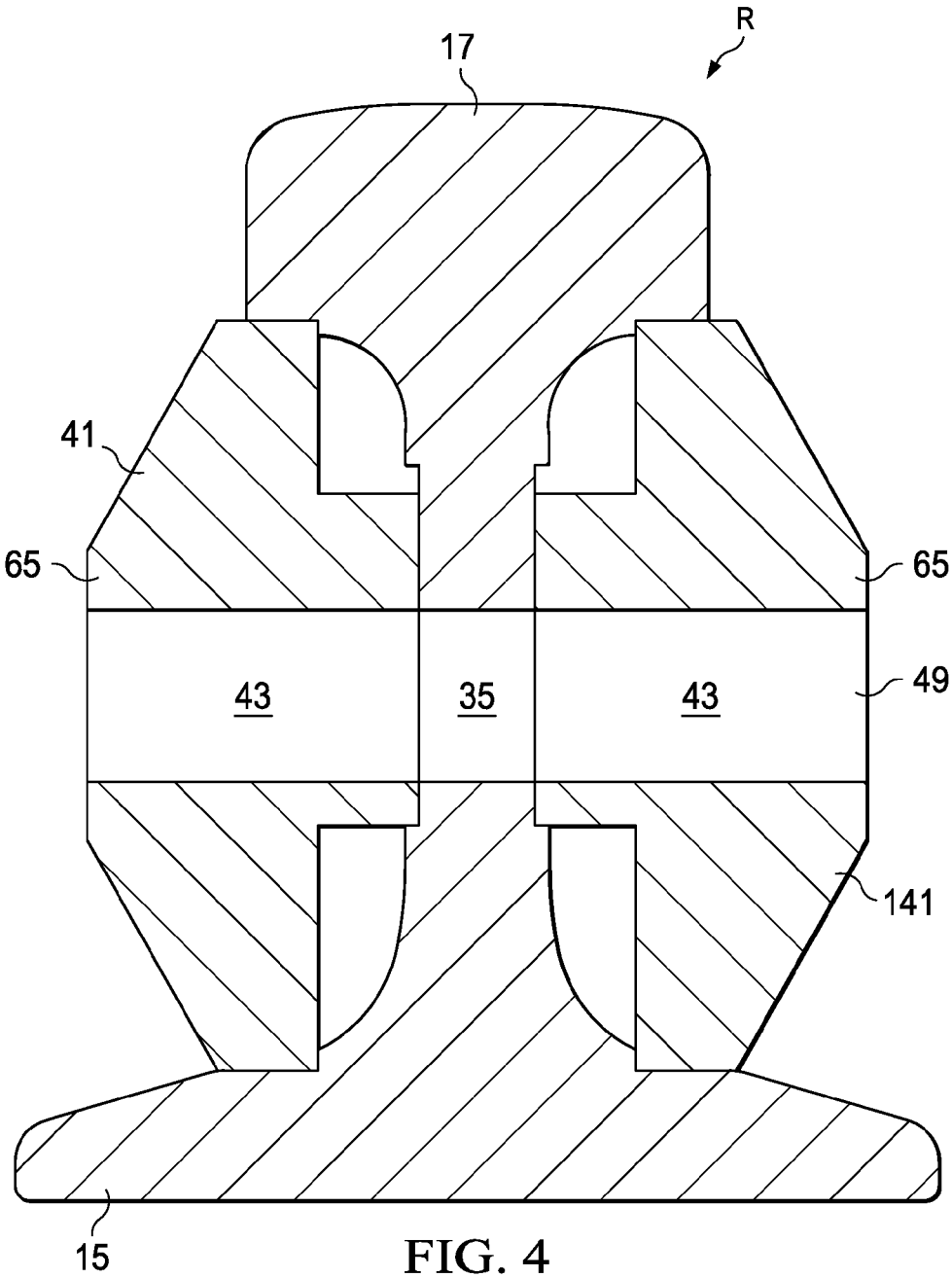
FIG. 4 is a cross-sectional view taken along the lines 4-4 of the leveling rail joint of FIG. 2.

The joint bodies 41 and 141 are thus comparable construction, with their relative position in their longitudinal extent along the rails R reversed. For this reason comparable structure in each bears like reference numerals. The contact surfaces 53 of the joint bodies 41 and 141 thus face inwardly in the assembled leveling joint L, as shown in FIGS. 3 and 4, to engage corresponding outwardly facing vertical surfaces 11 of rail end portions E (FIG. 1).

The leveling rail joints according to the present invention achieve increased strength in the assembled structure. The assembled joint bodies in place on the rail ends form a solid unitary structure. This structure functions is achieved as an assembly of several engaged pieces with their aligned contacting surfaces. However, should the need arise one of the structural components of the leveling rail joint can be readily changed in a short time for maintenance or replacement.

The leveling rail joints in accordance with the present invention enhance the strength of the rail and joint since the matching and engagement of the joint bodies with the corresponding surfaces on the rail ends cause the joint bodies to function in effect as two additional webs to the rail.

The leveling rail joints of the present invention provide accuracy in the vertical dimensions so that the heads of both rails have the same level at the upper part of the rail heads, making passage of the train wheels relatively noise free and without impact due to a change in height at the rail joint. The leveling rail joints also provide accuracy in the horizontal dimensions so that the connector bolts when installed compress the structural components of the joint with increased strength comparable to that of a solid, unitary piece. With the leveling rail joints of the present invention, gaps between the rails are not formed, so that impact on or movement of rails on passage of wheels is significantly diminished. This in turn affords fewer maintenance needs, safer operation and cost savings.

Having described the invention above, various modifications of the techniques, procedures, material and equipment will be apparent to those in the art. It is intended that all such variations within the scope and spirit of the appended be embraced thereby.

What is claimed is:

1. A leveling joint connector bar for longitudinally connecting adjoining end portions of rails end-to-end lengthwise to each other in a track structure, the end portions of the rails to be longitudinally connected being of different height, and further having connector holes in their web portions at different heights, respectively, from each other, the end portions of the rails of different heights having flat vertical surfaces of different heights on their respective end portions, and different vertical spacing between respective head and base portions thereof, the leveling joint connector comprising:

an elongate joint body to longitudinally span the adjoining end portions of the rails to be joined and having a number of connector holes formed therein at different heights for alignment with the connector holes in the web portions of the adjoining end portions of the rails of different height to be joined;

the elongate joint body having a height along its longitudinal extent conforming to the different vertical spacing between the respective head and rail portions of the adjoining end portions of the rails to be joined;

an engaging shoulder member formed with and extending along the length of the joint body, the engaging shoulder member having a number of connector holes formed at different heights therein aligned with the connector holes at different heights in the joint body and the connector holes in the web portions of the adjoining end portions of the rails of different height to be joined;

the engaging shoulder member having an inwardly extending portion having a flat vertical contact surface at different heights thereon for engaging the flat vertical surfaces of different heights on the web portions of the adjoining end portions of the rails of different height to be joined;

the joint body being located outwardly of the engaging shoulder member and adapted to be fitted between head and base portions of the adjoining end portions of the rails of different height to be joined;

the joint body having a downwardly extending contact rib member formed along its length;

the downwardly extending contact rib member having horizontal contact surfaces formed thereon for engaging with corresponding horizontal flat surfaces formed on a sloped surface of the respective base portions of the adjoining end portions of the rails to be joined;

the joint body having an upper contact rib member formed on an upper surface thereof extending along its length;

the upper contact rib having a horizontal upper contact surface thereon for engaging corresponding horizontal flat surfaces below the respective head portions of the adjoining end portions of the rails to be joined;

the joint body having a different height between the downwardly extending contact rib member and the upper contact rib along its length to correspond to the vertical spacing between respective head and rail portions of the rails of different height; and the spacing of the vertical surface of the engaging shoulder member from the contact surfaces on the upper and lower contact rib members corresponding to the spacing of the flat vertical surfaces on the web portions from the horizontal flat surfaces on the rail base portion and the horizontal flat surfaces below the head portion of the rails to be joined.

2. The leveling joint of claim 1, wherein the horizontal flat surface on the rail base portion is formed at a location between an outer edge of base portions and the webs of the adjoining end portions of the rails.

3. The leveling joint of claim 1, wherein the horizontal flat surface below the head portions of the rail are formed extending inwardly from a vertical side surface of the head portions of the adjoining end portions of the rails to be joined.

4. The leveling joint of claim 1, wherein the joint body has a support segment around the central port and extending outwardly beyond the head portions of the rails to provide additional strength to the assembled leveling joint.

5. A rail track structure formed at adjoining longitudinal end portions of rails joined end-to-end lengthwise to each other, the rail end portions having differing height characteristics, comprising:

a first track segment and a second track segment, each having a web portion, a base portion and a head portion, the end portions of the first and second track segments being of different heights and having flat vertical surfaces of different heights on their respective end portions, and different vertical spacing between respective head and base portions thereof;

the web portions of the first and second track segments having a number of connector holes formed therein at different heights, respectively, from each other for the passage of connectors at their end portions;

the head portions of the first and second track segments having horizontal flat surfaces formed on lower portions thereof;

the base portion of the first track segment having horizontal flat surfaces formed on upper portions thereof;

an elongate connector bar to longitudinally span the adjoining end portions of the first and second track segments to be joined end-to-end lengthwise and having a number of connector holes formed therein at different heights for alignment with the connector holes in the web portions of the adjoining end portions of the first and second track segments of different height to be joined;

the elongate connector bar having a height along its longitudinal extent conforming to the different vertical spacing between the respective head and rail portions of the adjoining end portions of the first and second track segments to be joined;

an engaging shoulder member extending along the length of the connector bar, the engaging shoulder member having a number of connector holes formed at different heights therein aligned with the connector holes at different heights in the connector bar and the connector holes in the web portions of the adjoining end portions of the first and second track segments of different height to be joined;

the engaging shoulder member having an inwardly extending portion having a flat vertical contact surface at different heights thereon for engaging the flat vertical surfaces of different heights on the web portions of the adjoining end portions of the first and second track segments of different height to be joined;

the connector bar being located outwardly at the engaging shoulder and adapted to be fitted between head and base portions of the adjoining end portions of the first and second track segments of different height to be joined;

the connector bar having a downwardly extending contact rib member formed along its length; and the downwardly extending contact rib member having horizontal contact surfaces formed thereon for engaging with corresponding horizontal flat surfaces formed on sloped surfaces of base portions of the respective adjoining end portions of the first and second track segments to be joined;

the connector bar having an upper contact rib member formed on an upper surface thereof extending along its length;

the upper contact rib member having a horizontal upper contact surface thereon for engaging corresponding horizontal flat surfaces below the respective head portions of the adjoining end portions of the first and second track segments to be joined;

the connector bar having a height between the downwardly extending contact rib member and the upper contact rib along its length to correspond to the vertical spacing between respective head and rail portions of the first and second track segments of different height; and the spacing of the vertical surface of the engaging shoulder member from the contact surfaces on the upper and lower contact rib members corresponding to the spacing of the flat vertical surfaces on the web portions from the horizontal flat surfaces on the rail base portion and the horizontal flat surfaces below the head portion of the first and second track segments to be joined.

6. The rail track structure of claim 5, wherein the elongate connector member is located on a first side of the adjoining end portions of the first and second track segments, and further including:

a second elongate connector bar to longitudinally span the adjoining end portions of the first and second track segments to be joined end-to-end lengthwise and having a number of connector holes formed therein at different heights for alignment with the connector holes in the elongate connector member and the web portions of the adjoining end portions of the first and second track segments of different height to be joined;

the second elongate connector bar having a height along its longitudinal extent conforming to the different vertical spacing between the respective head and rail portions of the adjoining end portions of the track segments to be joined;

an engaging shoulder member extending along the length of the second connector bar, the engaging shoulder member having a number of connector holes formed at different heights therein aligned with the connector holes at different heights in the second connector bar and the connector holes in the elongate connector member and the web portions of the adjoining end portions of the first and second track segments of different height to be joined;

the engaging shoulder member having an inwardly extending portion having a flat vertical contact surface at different heights thereon for engaging the flat vertical surfaces of different heights on the web portions of the adjoining end portions of the first and second track segments of different heights to be joined;

the second connector bar being located outwardly of the engaging shoulder and adapted to be fitted between head and base portions of the adjoining end portions of the first and second track segments of different heights to be joined;

the second connector bar having a downwardly extending contact rib member formed along its length; and the downwardly extending contact rib member of the second connector bar having horizontal contact surfaces formed thereon for engaging with corresponding horizontal flat surfaces formed on sloped surfaces of the respective base portions of the adjoining end portions of the first and second track segments to be joined;

the second connector bar having an upper contact rib member formed on an upper surface thereof extending along its length;

the upper contact rib member having a horizontal upper contact surface thereon for engaging corresponding horizontal flat surfaces below the respective head portions of the adjoining end portions of the first and second track segments to be joined;

the second connector bar having a height between the downwardly extending contact rib member and the upper contact rib along its length to correspond to the vertical spacing between respective head and rail portions of the first and second track segments of different height; and the spacing of the vertical surface of the engaging shoulder member from the contact surfaces on the upper and lower contact rib members corresponding to the spacing of the flat vertical surfaces on the web portions on the web portions from the horizontal flat surfaces on the rail base portion and the horizontal flat surfaces below the head portion of the first and second track segments to be joined.

* * * * *